US006142709A

United States Patent [19]

De Medeiros Junio et al.

[11] Patent Number: 6,142,709

[45] **Date of Patent: *Nov. 7, 2000**

[54] FOUNDATION SYSTEM FOR TENSION LEG PLATFORMS

[75] Inventors: Cipriano José De Medeiros Junio, Rio de Janeiro; Elisabeth De Campos Porto, Rio de Janeiro; Maria Marta De Castro Rosas, Rio de Janeiro; Isaías Quaresma Masetti, Rio de Janeiro, all of Brazil

[73] Assignee: Petroleo Brasileiro S.A. - Petrobras, Brazil

[ * ] Notice: This patent is subject to a terminal disclaimer.

[21] Appl. No.: 09/272,165

[22] Filed: Mar. 18, 1999

Related U.S. Application Data

[62] Division of application No. 09/059,999, Apr. 15, 1998, Pat. No. 6,036,404, which is a division of application No. 08/733,698, Oct. 17, 1996, which is a continuation of application No. 08/298,753, Aug. 31, 1994, abandoned.

[30] Foreign Application Priority Data

Aug. 31, 1993 [BR] Brazil ..... 9303646

[51] Int. Cl.[7] ..... E02D 5/74; E02D 5/40; E02D 5/00

[52] U.S. Cl. ..... 405/224; 405/195.1; 405/223.1; 405/227

[58] Field of Search ..... 405/224, 223.1–4, 405/224.1–3, 227, 195.1, 203, 204, 205; 114/264, 265

[56] References Cited

U.S. PATENT DOCUMENTS

| | | |
|---|---|---|
| 2,960,832 | 11/1960 | Hayward . |
| 3,496,900 | 2/1970 | Mott . |
| 3,646,770 | 3/1972 | Van Daalen . |
| 3,779,025 | 12/1973 | Godley et al. . |

(List continued on next page.)

FOREIGN PATENT DOCUMENTS

| | | |
|---|---|---|
| 623 085 | 3/1989 | Australia . |
| 1194856 | 10/1985 | Canada . |
| 177197 | 4/1986 | European Pat. Off. . |
| 0 302 546 | 2/1989 | European Pat. Off. . |
| 0 441 413 | 8/1991 | European Pat. Off. . |
| 2 034 378 | 6/1980 | United Kingdom . |
| 2 035 240 | 6/1980 | United Kingdom . |
| 2 178 101 | 2/1987 | United Kingdom . |
| 2178101 | 2/1987 | United Kingdom . |
| 2 198 171 | 6/1988 | United Kingdom . |
| WO 95/29839 | 11/1995 | WIPO . |

OTHER PUBLICATIONS

John Abbott, Auger Tension Leg Platform, pp. 20–30 (undated).

John Abbot, Mars Tension Leg Platform, pp. 14–24 (undated).

(List continued on next page.)

*Primary Examiner*—Dennis L Taylor
*Attorney, Agent, or Firm*—Nixon & Vanderhye PC

[57] ABSTRACT

A foundation system for tension leg platforms without use of foundation templates, wherein each tendon (5) is directly connected to a socket (9) inside the pile (8), said piles (8) being positioned for driving purpose by means of a pile-driving template (10) which is employed as a spacing device is described. The pile-driving template (10) is positioned with the aid of pins (11) that slot into guides (7) built into the well template (6). After the groups of piles (8) needed to anchor a corner of the platform (1) have been driven in, the pile-driving template (10) is withdrawn and repositioned so as to enable the piles for the other group of legs to be driven; this process continues until all of the pile-driving is finished. Alternatively one single pile-driving template (16) may be employed to guide the driving of all the piles (8) thus doing away with the need to reposition the template every time. The bottom ends (14) of the piles are conical in shape, and after the piles have been driven they are filled up with some high specific gravity material.

3 Claims, 6 Drawing Sheets

U.S. PATENT DOCUMENTS

| | | | |
|---|---|---|---|
| 3,955,521 | 5/1976 | Mott . | |
| 4,126,008 | 11/1978 | Dixon . | |
| 4,198,179 | 4/1980 | Pease et al. . | |
| 4,226,555 | 10/1980 | Bourne et al. . | |
| 4,248,549 | 2/1981 | Czeyewaty . | |
| 4,285,615 | 8/1981 | Radd . | |
| 4,344,721 | 8/1982 | Goldsmith | 405/224 |
| 4,351,258 | 9/1982 | Ray . | |
| 4,352,599 | 10/1982 | Goldsmith | 405/224 |
| 4,374,630 | 2/1983 | Fraser . | |
| 4,386,874 | 6/1983 | Engelson . | |
| 4,391,554 | 7/1983 | Jones | 405/224 |
| 4,432,670 | 2/1984 | Lawson . | |
| 4,459,933 | 7/1984 | Buchett . | |
| 4,516,882 | 5/1985 | Brewer et al. . | |
| 4,540,314 | 9/1985 | Falkner . | |
| 4,597,350 | 7/1986 | Mott . | |
| 4,611,953 | 9/1986 | Owens . | |
| 4,614,461 | 9/1986 | Taniguchi et al. | 204/196.19 |
| 4,620,820 | 11/1986 | Collipp . | |
| 4,637,757 | 1/1987 | Aagaard . | |
| 4,669,917 | 6/1987 | Sveen . | |
| 4,687,062 | 8/1987 | Beghetto . | |
| 4,768,455 | 9/1988 | Maxson et al. | 114/264 |
| 4,780,029 | 10/1988 | Gunderson | 405/224 |
| 4,784,224 | 11/1988 | Leach . | |
| 4,784,527 | 11/1988 | Hunter . | |
| 4,784,529 | 11/1988 | Hunter . | |
| 4,818,147 | 4/1989 | Rasmussen . | |
| 4,844,659 | 7/1989 | Hunter et al. | 405/224 |
| 4,848,970 | 7/1989 | Hunter . | |
| 4,875,806 | 10/1989 | Linberg . | |
| 4,881,852 | 11/1989 | Gunderson | 405/224 |
| 4,895,481 | 1/1990 | Pepin-Lehalleur . | |
| 4,907,914 | 3/1990 | Gunderson . | |
| 4,943,188 | 7/1990 | Peppel . | |
| 4,990,030 | 2/1991 | Salama . | |
| 5,114,276 | 5/1992 | Dupin . | |
| 5,118,221 | 6/1992 | Copple . | |
| 5,174,687 | 12/1992 | Dunlop et al. | 405/223.1 |
| 5,197,825 | 3/1993 | Rasmussen . | |

OTHER PUBLICATIONS

Offshore Rig Report, Ocean Oil Weakly Report, Apr. 1, 1996, p. 8.

Danny Keener, "Positioning the Mars TLP tendons and free–standing piles", Offshore, Jul. 1996, pp. 64 & 66.

"Mars on the move", Offshore Engineer, Apr. 1994, p. 41.

John Abbott, RAM/Powell Tension Leg Platform, pp. 8–13 (undated).

Sprague, Completion of Hutton Field Pre–Drilled Wells From A Semi–Submersible, Advances in Underwater Technology and Offshore Engineering: vol. 2: Design and Installation of Subsea Systems pp.77–105. 1985 (abstract only).

Gunton, The Nort Sea–Home of Technological Achievement, Oil Gas Australia, pp36, 39 Nov. 1985 (abstract only).

Tebbett et al., Design and Installation of Piled Foundations for Seabed Structures, Subsea '85 Int. Conf. (London Dec. 3–4, 1985), 24 pp. 1985 (abstract only).

Chaplin, Template Installations for Floating/Tethered Systems, Ocean Ind., v. 21, No. 5, pp. 56–57, May 1986 (abstract only).

Dutta et al., Tubular Tendon for a Tension Leg Platform: Material Development and Threaded Connection Design, 17th Annu. SPE of AIME et al. Offshore Technol. Conf. (Houston, May 6–9, 1985) Proc., v. 4, pp 511–521, 1985 (abstract only).

World's First TLP [Tension Leg Pal\\latform] Producing Hutton Field Oil—Petrol. Eng. Int., v. 56, No. 12, pp10, 14, Oct. 1984 (abstract only).

Takeshi et al., Research and Development of a Three–Piece Tendon for a TLP [Tend\sion Leg Platform], 17th Annu. SPE of AIME et al. Offshore Technol. Conf. (Houston, May 6–9, 1985) Proc., v. 4, pp 499–510, 1985 (abstract only).

Sparks et al., P1 TR 1000—A Concrete Tension Leg Platform; 4th ASME et al. Int. Offshore Mech. & Arctic Eng. Symp. (Dallas, Feb. 17–21, 1985) Proc., v. 1, pp 14–21, 1985 (abstract only).

Taylor, Conoco's Tension Leg Platform Will Double Water Depth Capability, Ocean Ind., v. 15, No. 2, pp 35–39, Feb. 1980 (abstract only).

Monitoring Moorings of North Sea Platforms, Contr. Instrum., v. 15, No. 1, p. 43, Jan. 1983 (abstract only).

Franco, Jolliet's TLWP [Tension Leg Well Platform] Brings Innovation to the Gulf, Drilling Contract, v. 45, No. 4, pp. 9–11, Jun.–Jul. 1989 (abstract only).

Hagar, Conoco Slates Pioneering TLWP [Tension Leg Well Platform] Off Louisana, Oil Bas J., v. 85, No. 9, pp. 18–19, Mar. 2, 1987 (abstract only).

Sparks, PLTB 1000: A Concrete Tension Line Platform for 1000 Meters Water Depth; Petrol Tech., No. 322, pp. 35–37, Jan.–Feb. 1986 (abstract only).

Tassini et al., Floating Production System for Mediterranean Deep Water Areas, 3rd Deep Offshore Technol. [Dot]Int. Conf. (sorrento Italy, Jul. 21–23, 1985) Proc. v. 2, pap. No. IIL11, 1985 (abstract only).

Sebastiani et al., Theoretical–Experimental Behavior of TLP [Tension Leg Platform] for Very Deep Waters, 2nd Int. ASME Offshore Mech. & Arctic Eng. Symp. (Houston, Jan. 30, 1983–Feb. 3, 1983) Proc., pp. 1–14, 1983 (abstract only).

FOUNDATION SYSTEM FOR TENSION LEG PLATFORMS

This is a Divisional of application Ser. No. 09/059,999, filed Apr. 15, 1998, now U.S. Pat. No. 6,036,404, which was a Divisional of appln. Ser. No. 08/733,698, filed Oct. 17, 1996, which was a Continuation of appln. Ser. No. 08/298, 753, filed Aug. 31, 1994 now abandoned.

FIELD OF INVENTION

This invention relates to a foundation system for tension leg platforms where tendons are anchored directly to sockets fitted inside the piles thereby doing away with the need to make use of rigid structures known as foundation templates.

STATE OF THE ART

Various kinds of anchoring pile systems for tension leg platforms —TLPs—are known. In all of them transfer of the anchored load to the piles is achieved by means of a structure in the sea bottom, known as a foundation template. This template has cylindrically shaped guides into which are driven tubular piles which are fixed to the foundation template either by cementing the annular space between the cylindrically shaped guide and the pile, or by deforming the steel of the pile with the aid of a tool which expands it against the guide, thereby bringing about a mechanical connection between the pile and the guide.

U.S. Pat. No. 4,620,820 illustrates a foundation system such as the one described above and discloses equipment and an anchoring system for a tension leg platform anchored to the sea bottom by means of an anchoring assembly made up of upper and lower parts. The upper part thereof is tied to the bottom ends of the tendons forming the tension legs of the tension leg platform. The upper part of the anchoring assembly serves to space out and line up each tendon, keeping them straight when the upper part of the assembly is joined to the lower part which has first of all been fixed to the sea bottom by means of the piles.

The foundation templates have to withstand cycles of heavy strain and must therefore be designed to withstand the ensuing fatigue which inevitably leads to their being sturdily and heavily built, thereby increasing the anchoring cost. Another critical point is that the joining of piles to the templates is prone to failure.

The invention described and claimed herein introduces significant modifications in such a system, does away with the need for templates in the foundations, cuts down on the cost of anchoring and considerably reduces the likelihood of failure since there are fewer mechanical parts.

SUMMARY OF THE INVENTION

For the purpose of principally doing away with the need for foundation templates, thus diminishing the cost of materials and the installation costs, this invention provides a tension leg platform foundation system wherein each tendon is directly connected to its pile by means of a socket fitted into the pile, the piles being driven in with the aid of a template which also serves to keep the piles apart from the template for the wells as they are positioned by means of pins that slot into guides fitted into the well-drilling template. After piles have been driven to anchor down one corner of the platform the template is withdrawn, and repositioned, so as to enable the piles for the other tendons to be driven, this procedure is repeated until all the piles have been driven.

The pile-driving template can also be built so as to serve as a guide for all of the piles thereby doing away with the need to reposition the template after each group of piles has been driven.

BRIEF DESCRIPTION OF THE DRAWINGS

These and other purposes of this invention will be more easily perceived from the following detailed description given with reference to the accompanying drawings, in which.

DETAILED DESCRIPTION OF THE INVENTION

Figure 1:
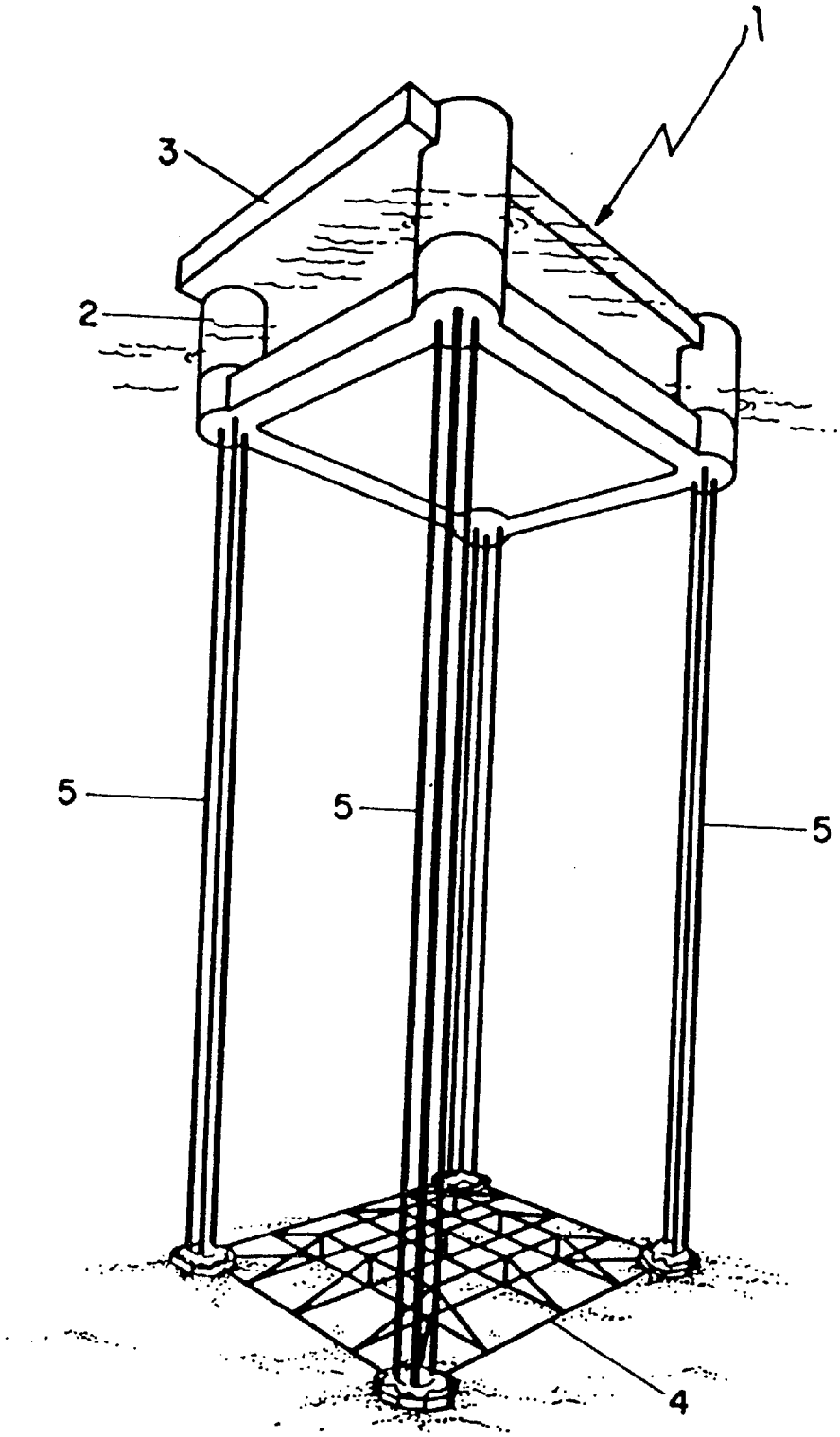
FIG. 1 is a partial view, in perspective, of an offshore platform anchored by tension legs attached to a foundation template fixed to the sea bottom.

Conventional tension leg platforms have their tendons anchored to a foundation structure fixed to the bottom of the sea by means of piles or by gravity alone. FIG. 1 is a perspective view of an offshore platform (1) held up by columns (2) arranged about the corners of a supporting structure (3), which is anchored to a foundation structure (4) by means of tendons (5). The foundation structure (4), referred to by those skilled in the art as a template, is fixed to the sea bottom by means of tubular piles (not shown in the drawing).

It should be pointed out that, in order to make it easier to understand the attached drawings, this description merely covers parts directly connected therewith; any other parts needed to complete the picture, and widely known by the experts, have been left out along with certain details thereof.

For the purpose of dispensing with the need for foundation templates which, because they have to stand up to cycles of heavy strain, must therefore be designed to withstand the ensuing fatigue which inevitably leads to their being sturdily and heavily built, and costly, this invention provides a foundation system for tension leg platforms as shown in FIGS. 2 to 5.

Figure 2:
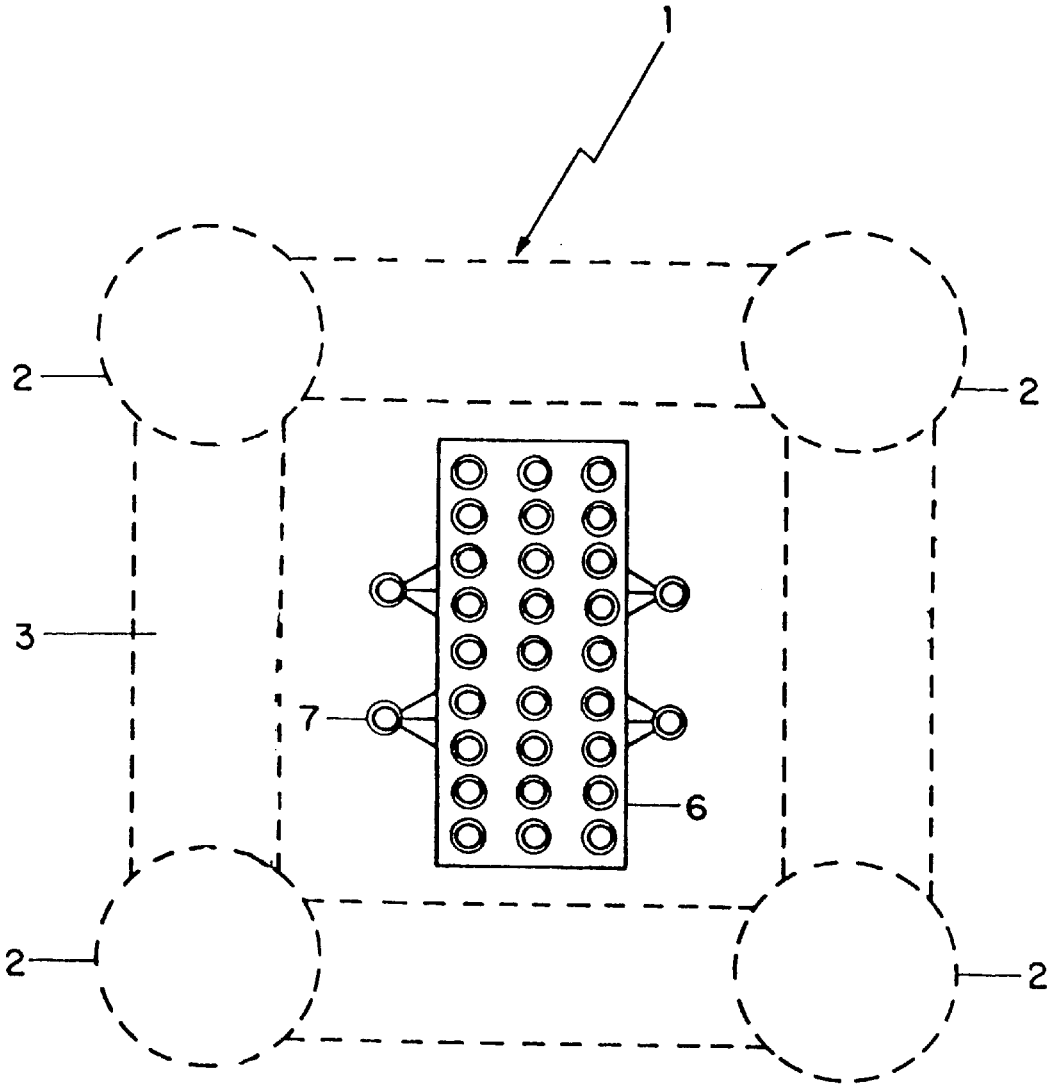
FIG. 2 is a schematic top plan view of a platform positioned over the well template.
Figure 3:
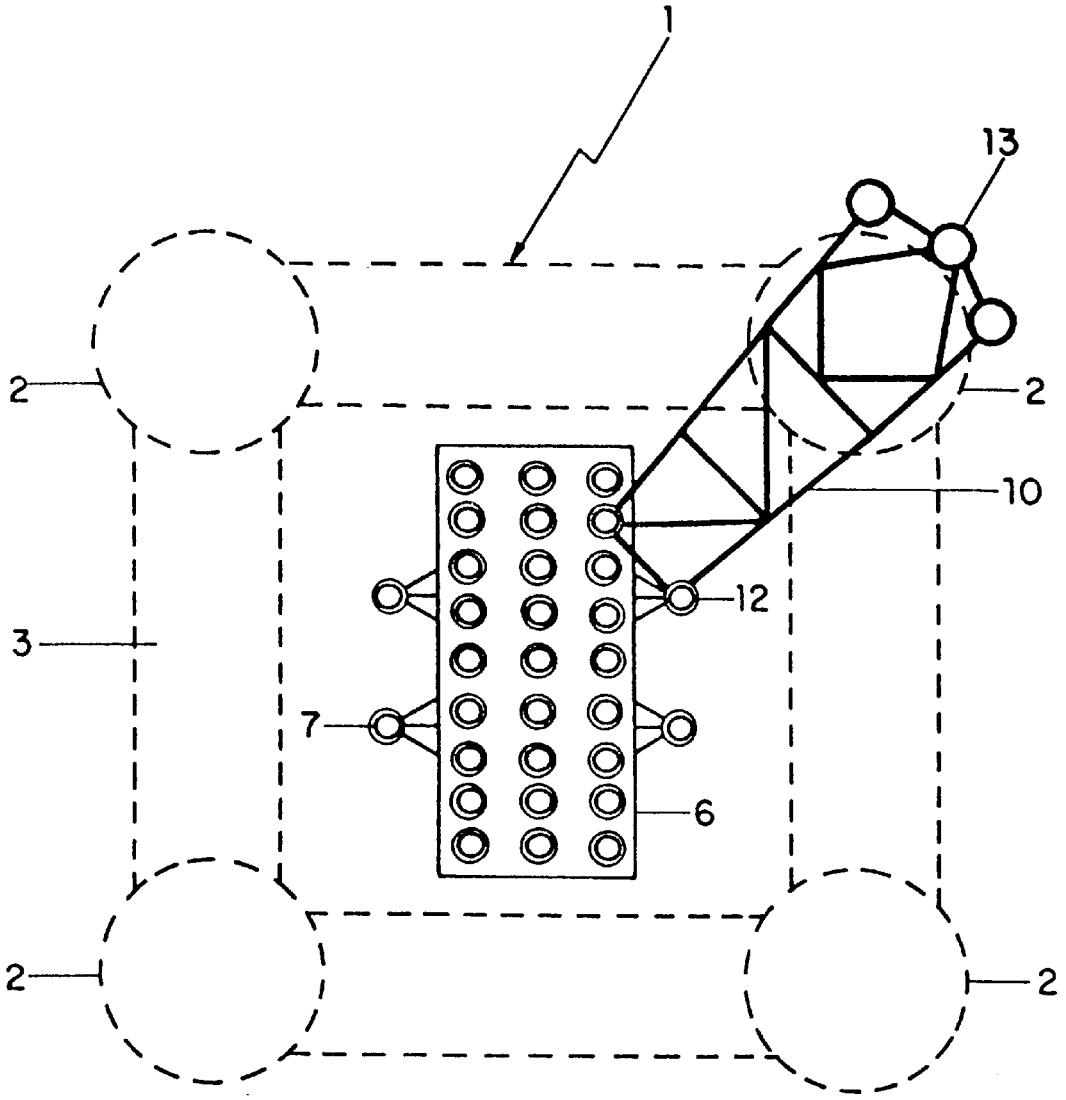
FIG. 3 is a schematic top plan view of a platform positioned over a well template and a pile-driving template.

FIGS. 2 and 3 are schematic top plan views of a supporting structure (3) for a tension leg platform positioned over a well template (6) fixed to the sea bottom, the well template (6) having guides (7) that serve to position the template (10) as will be described later.

Figure 4:
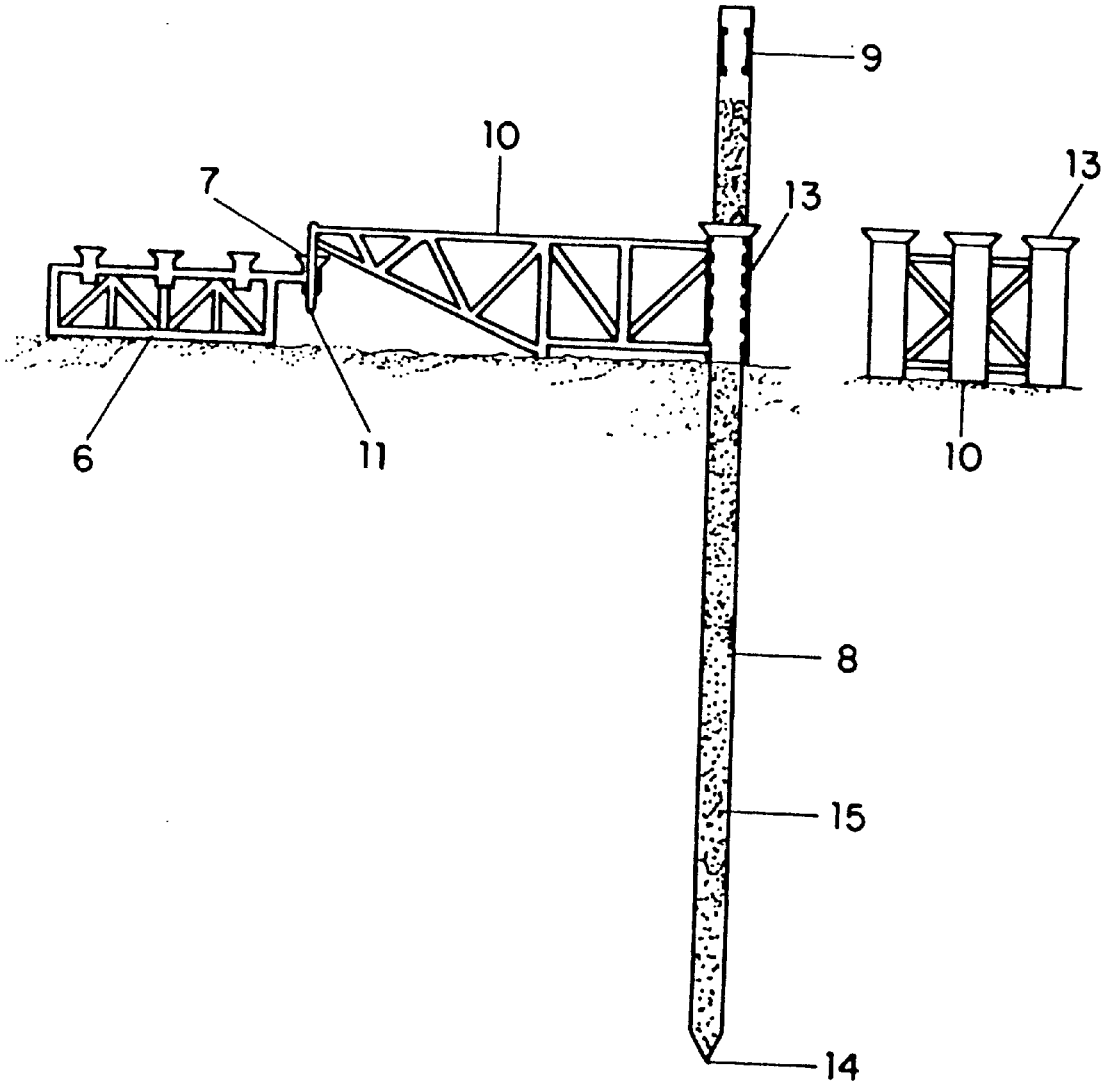
FIG. 4 is a schematic side view of the foundation system of the invention for a tension leg platform, and includes a schematic front view of the pile-driving template.

FIG. 4 shows piles (8) driven in with the aid of a pile-driving template (10), which is a tubular structure, and which also serves to keep the groups of piles apart from the production template. The pile-driving template (10) is positioned with the aid of pins (11) which slot into guides (7) fitted on the well template (6).

The pile-driving template (10) is a tubular structure whose top part is fitted with pins (11) that slot into the guides (7) of the well template (6) so as to ensure proper positioning of piles (8) before they are driven into the sea bed through guides (13) fitted into the front of the pile-driving template (10).

Figure 5:
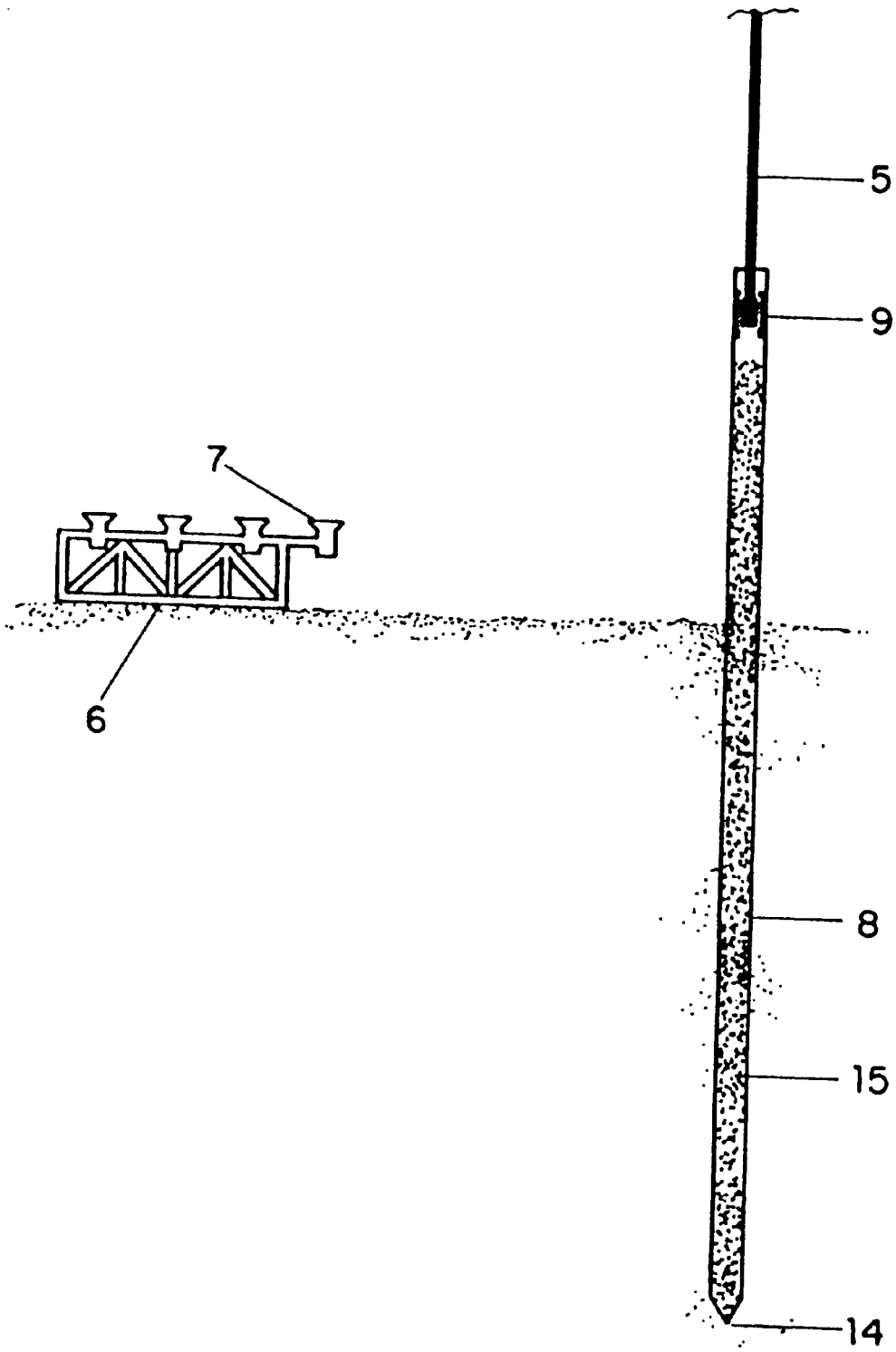
FIG. 5 is a schematic view showing how a tendon fits into a pile.

FIG. 5 shows a tendon (5) fitted directly into socket (9) built into the pile (8), thus eliminating any need for a foundation template such as is shown at (4) in FIG. 1. Those skilled in the art will understand that more than one pile may be used to fix a tendon and also that more than one tendon may be fixed to a pile.

Figure 6:
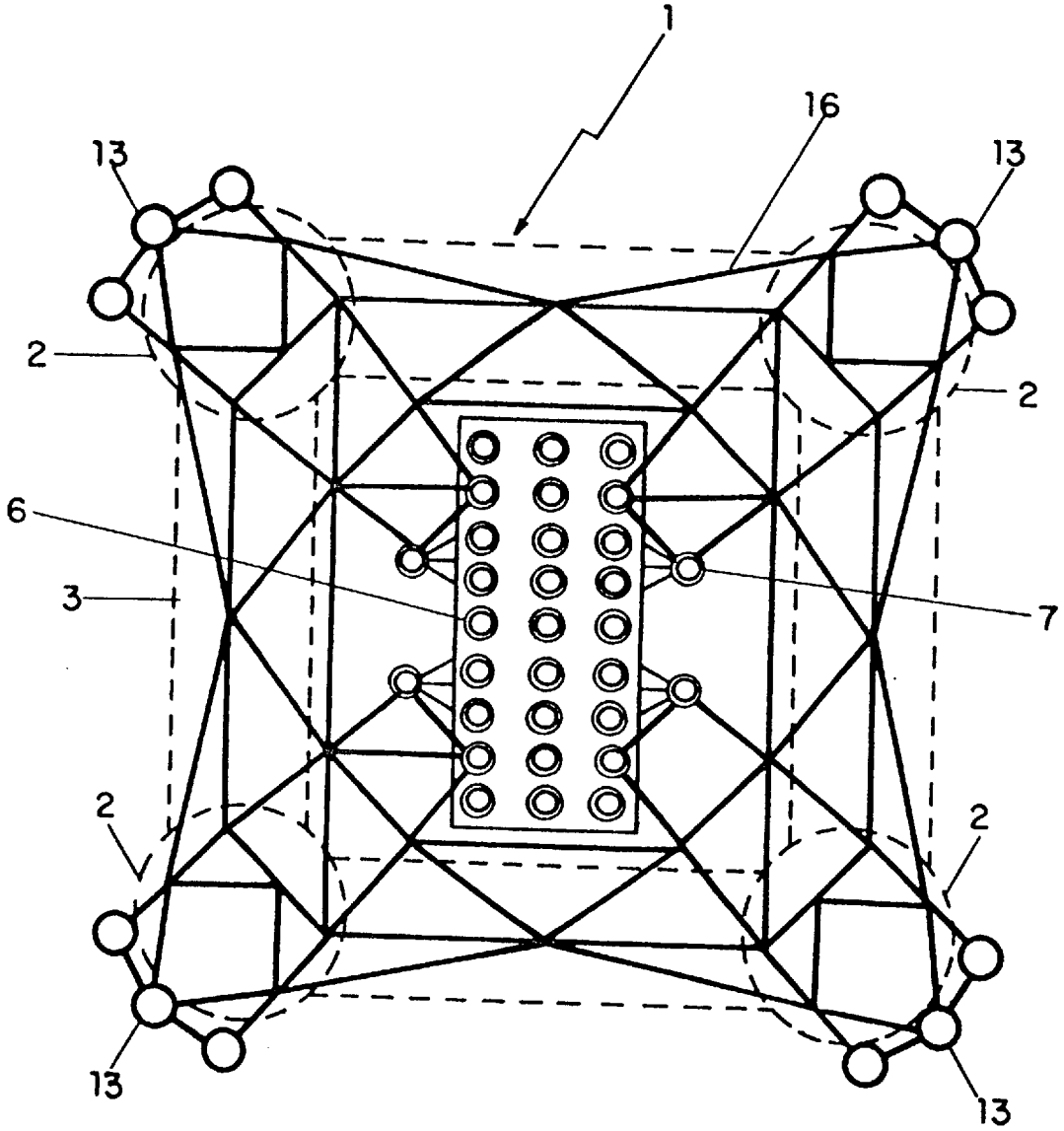
FIG. 6 is a schematic top plan view of a platform positioned over the well template and the pile-driving template, which latter serves as a guide for all of the piles.

After piles (8) have been driven to anchor a corner of the platform (1), the pile-driving template (10) is withdrawn and repositioned so as to enable the piles for the remaining tendons to be driven. This procedure is continued until all of the piles have been put in. The template (10) may also be built so that one template (10) can serve as a guide for the driving of all of the piles (8) as a whole without repositioning. Such an alternative is shown in FIG. 6, where a single template (16) eliminates the need to reposition after every group of piles has been driven. Either of these two kinds of templates may or may not be raised from the sea bottom after all of the piles have been driven.

For greater anchoring reliability use it is suggested that piles (8) be used which have closed conically shaped ends (14) as disclosed in our AU-B 623085.

After the pile (8) has been driven, its conical end (14) must be filled up with high specific gravity ballast (15). Thus, anchoring strains suffered by the platform are borne by the very weight of the pile/ballast assembly. Only when ambient conditions become extremely bad, to the extent that part of the pull away load becomes greater than such weight, will the ground into which the foundations have been laid suffer any strain. Use of such a pile/ballast method diminishes the effects of cyclic loads in the breaking down of clayish formations, since the ground will be subjected to such forces only in stormy weather which lasts only for a short while and does not happen very often.

In addition to increasing the anchoring capacity, the ballast (15) for the piles (8) allows for shallower driving and for shorter piles, which means easier and cheaper handling. Ballast, which is not employed in conventional kinds of foundations, consists of low cost material, preferably hematite.

Adoption of the above described system in the design of tension leg platforms will lead to a considerable reduction in not only the cost of materials but also the installatio costs, since there is no need for a foundation template (4) to drive the piles; such a template accounts for a considerable portion of the overall cost of anchoring.

Another point to be considered is the high cost of having to work upon the foundation template in the event of damage to platform tendons, which will not apply in the case of the system proposed herein because the tendon anchoring systems are independent of one another. If damage does occur it will only be to the the socket (9) of the pile.

What is claimed is:

1. A template system for locating pile structures for securing a tension leg platform hull with respect to an ocean floor, comprising:

a well template for being fixed to an ocean floor; and at least one pile-driving template, each said pile-driving template having at least one coupling structure for operatively engaging a complementary coupling structure on said well template so as to determine a position of said pile-driving template relative to said well template, each said pile-driving template having at least one pile-driving guide for determining an installation location of a pile structure, whereby when said pile-driving template is coupled to said well template, said at least one pile-driving guide determines a position of the pile structure relative to said well template;

wherein said well template includes a plurality of said coupling structures, whereby a said pile-driving template can be selectively and sequentially coupled at a plurality of positions around a periphery of said well template.

2. A template system as in claim 1, wherein said pile-driving template includes a plurality of pile-driving guides.

3. A template system as in claim 1, wherein said coupling structure of said pile-driving template comprises a pin structure and said complementary coupling structure of said well template comprises a guide for receiving said pin structure.

* * * * *